US006336743B1

(12) United States Patent
Wang

(10) Patent No.: US 6,336,743 B1
(45) Date of Patent: Jan. 8, 2002

(54) SLIDE RAILS OF DROP-LEAF TABLE

(76) Inventor: Ming-cheng Wang, 1598-7, Chun Suan Rd., Shen Kang Hsiang, Taichung Hsien (TW)

( * ) Notice: Subject to any disclaimer, the term of this patent is extended or adjusted under 35 U.S.C. 154(b) by 0 days.

(21) Appl. No.: 09/472,749

(22) Filed: Dec. 27, 1999

(51) Int. Cl.[7] ..... A47B 1/10

(52) U.S. Cl. ..... 384/17; 74/89.17; 108/83; 108/87

(58) Field of Search ..... 74/89.17; 384/17; 108/83, 87

(56) References Cited

U.S. PATENT DOCUMENTS 1,860,019 A * 5/1932 Duncan ..... 384/17
1,907,111 A * 5/1933 Holland et al. ..... 108/87
2,003,926 A * 6/1935 Duncan ..... 384/17
2,005,213 A * 6/1935 Wurn ..... 384/17
2,015,599 A * 9/1935 Lawrence ..... 108/87
2,029,281 A * 1/1936 Yow ..... 108/87
2,751,269 A * 6/1956 Hafekost ..... 108/87

* cited by examiner

*Primary Examiner*—David A. Bucci
*Assistant Examiner*—William C Joyce
(74) *Attorney, Agent, or Firm*—W. Wayne Liauh

(57) ABSTRACT

A drop-leaf table has a sliding device comprising a primary rail, an inner rail, and an outer rail, which are all provided with the fitting slots, and the fitting protrusions. The primary rail has a connection plate which is provided with a rotary gear. The inner rail and the outer rail are provide with a connection plate having a row of toothed holes. The inner rail and the outer rail are slidably engaged with the primary rail such that the gear of the primary rail moves along the row of toothed holes. When one table leaf is pulled, the outer rail is pulled out along the primary rail such that the gear of the primary rail is actuated by the toothed holes to turn. The inner rail is then actuated by the gear in motion to slide in opposite direction, thereby causing two table leaves to slide in opposite directions at the same time.

7 Claims, 12 Drawing Sheets

SLIDE RAILS OF DROP-LEAF TABLE

FIELD OF THE INVENTION

The present invention relates generally to a drop-leaf table, and more particularly to slide rails of the drop-leaf table.

BACKGROUND OF THE INVENTION

As shown in FIG. 1, this inventor of the present invention discloses in the U.S. patent Ser. No. 09/280,897 two slide rails 6 for use in a drop-leaf table. The slide rails 6 are made of steel plates by rolling and are provided with a fitting slot 61 having a relatively wide mouth, and a fitting protrusion 62 having a relatively smaller mouth. Another slide rail 7 is provided with a fitting slot 71 which is fitted over the fitting protrusion 62. The slide rails 6 and 7 are fastened with the table leaves 68 and 78 by the connection pieces 66 and 76. When the table leaf 68 is pulled, the slide rail 6 is moved along. Now referring to FIG. 2, after the slide rail 6 is pulled out, it is necessary to pull another slide rail 7 out, thereby resulting in inconvenience in using the drop-leaf table.

As shown in FIG. 3, the slide rail 6 is provided at one end thereof with an arresting edge 64. In assembling the table, another end of the slide rail 6 is fitted with the slide rail 7. The slide rail 6 must be pulled out in the same direction so as to prevent being obstructed by the arresting edge 75. If the slide rail 6 is damaged, the table leaf 78 can not be removed because it is obstructed by the table leaf 68 which is located over the slide rail 6.

SUMMARY OF THE INVENTION

The primary objective of the present invention is to provide a drop-leaf table with slide rails enabling the table leaves to be moved simultaneously in opposite directions.

The slide rails of the present invention are made of the steel plates by rolling. The primary rail is provided with a fitting slot having a greater mouth and a fitting protrusion having a smaller mouth. Located between them is a connection plate which is provided in the middle thereof with a support seat provided with a rotary gear. The connection plate is provided in the inside of one end thereof and in the outer side of other end thereof with a connection piece riveted therewith for fastening the table leg. An inner rail and an outer rail are provided with a fitting slot and a fitting protrusion. The connection plates of the inner rail and the outer rail are provided with the toothed holes for receiving the toothed portion of the gear. The outer or inner side of another side is provided with a connection piece riveted therewith for fastening two table legs. When one table leaf is pulled, the outer rail is pulled out along the primary rail such that the gear is actuated by the toothed holes to turn. The inner rail is then actuated by the gear in motion to slide in opposite direction. As a result, two table leaves are in motion at the same time.

The connection plate of the primary rail is provided with a through hole opposite to the holes of the two connection pieces for locating two locating members. The toothed holes of the connection plates of the inner rail and the outer rail are provided in one side thereof with an arresting edge extending inward or outward by punching and pressing. When the inner rail and the outer rail are pulled out on the primary rail, they are prevented from sliding out of the primary rail by the arresting edges and the locating members. If the inner rail or the outer rail is damaged, the locating members can be taken out so as to enable the damaged rail to be pulled out for replacement.

BRIEF DESCRIPTION OF THE DRAWINGS

FIG. 5-1 shows a side view of the present invention in combination.

FIG. 5-2 shows a partial sectional view of FIG. 5-1

DETAILED DESCRIPTION OF THE INVENTION

Figure 1:
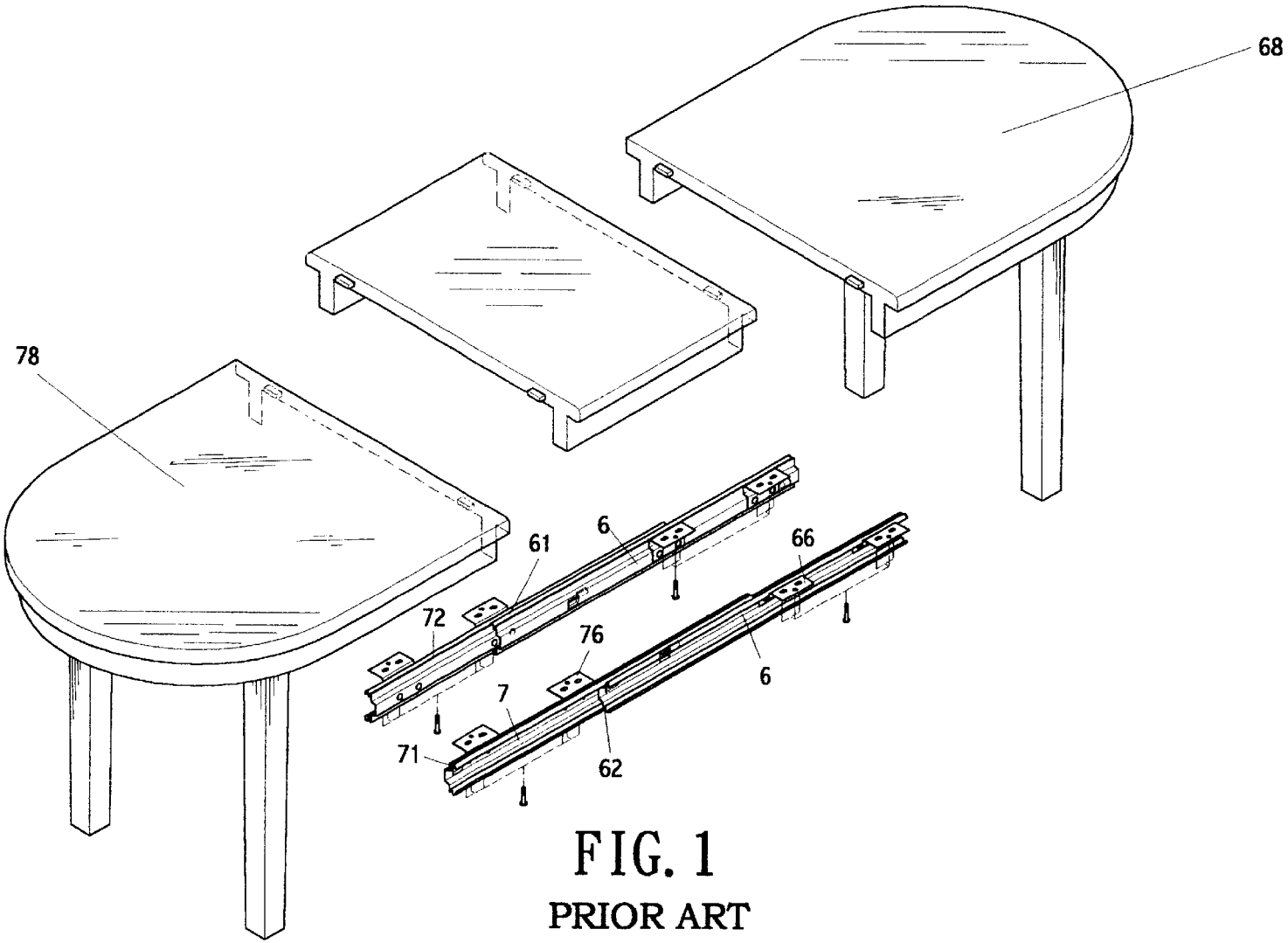
FIG. 1 PRIOR ART
FIG. 1 shows an exploded view of the structure disclosed in the U.S. patent Ser. No. 09/280,897.
Figure 2:
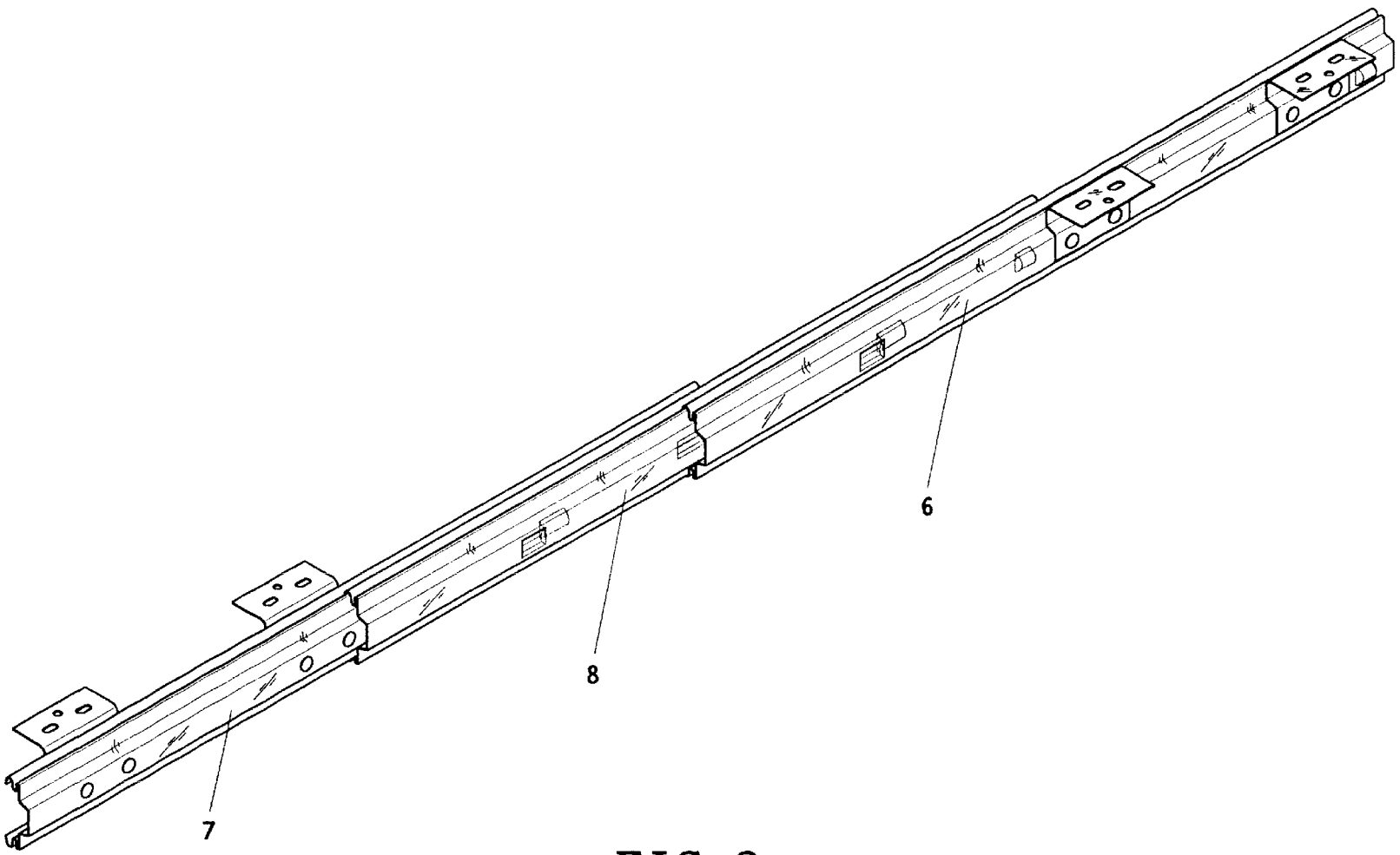
FIG. 2 PRIOR ART
FIG. 2 shows a schematic view of the slide rails of the U.S. patent Ser. No. 09/280,897.
Figure 3:
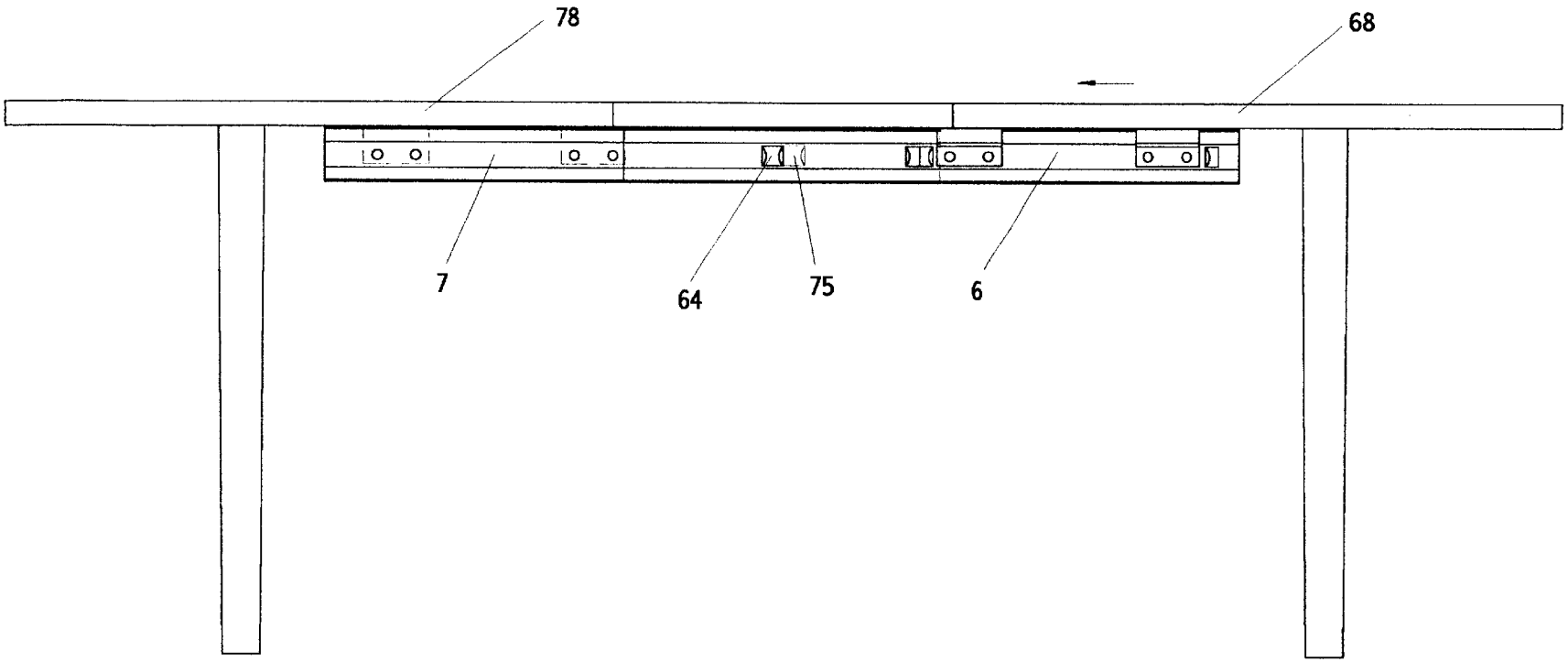
FIG. 3 PRIOR ART
FIG. 3 shows a schematic plan view of the structure in combination of the U.S. patent Ser. No. 09/280,897.
Figure 4:
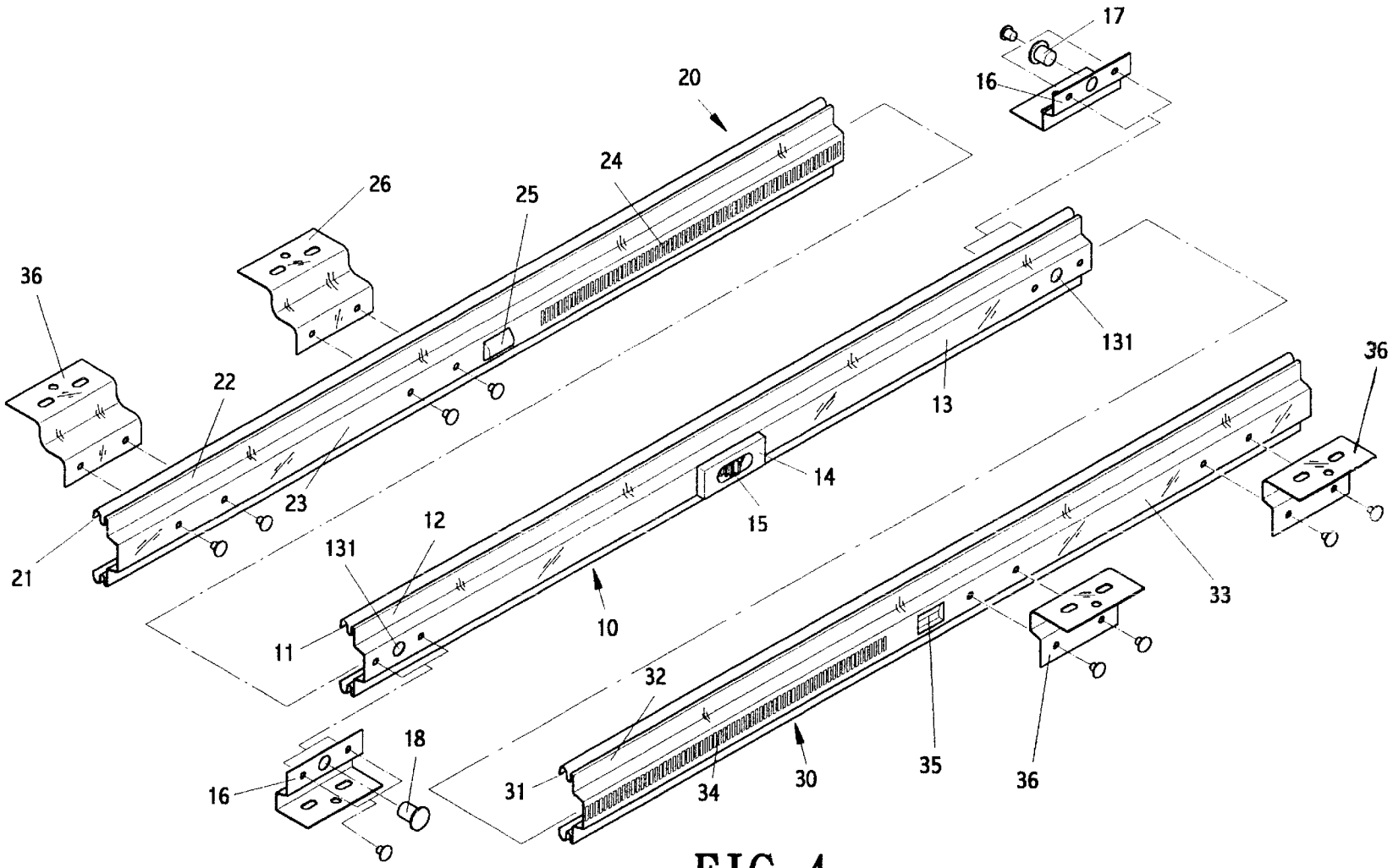
FIG. 4 shows an exploded view of the present invention.
Figures 1, 5:
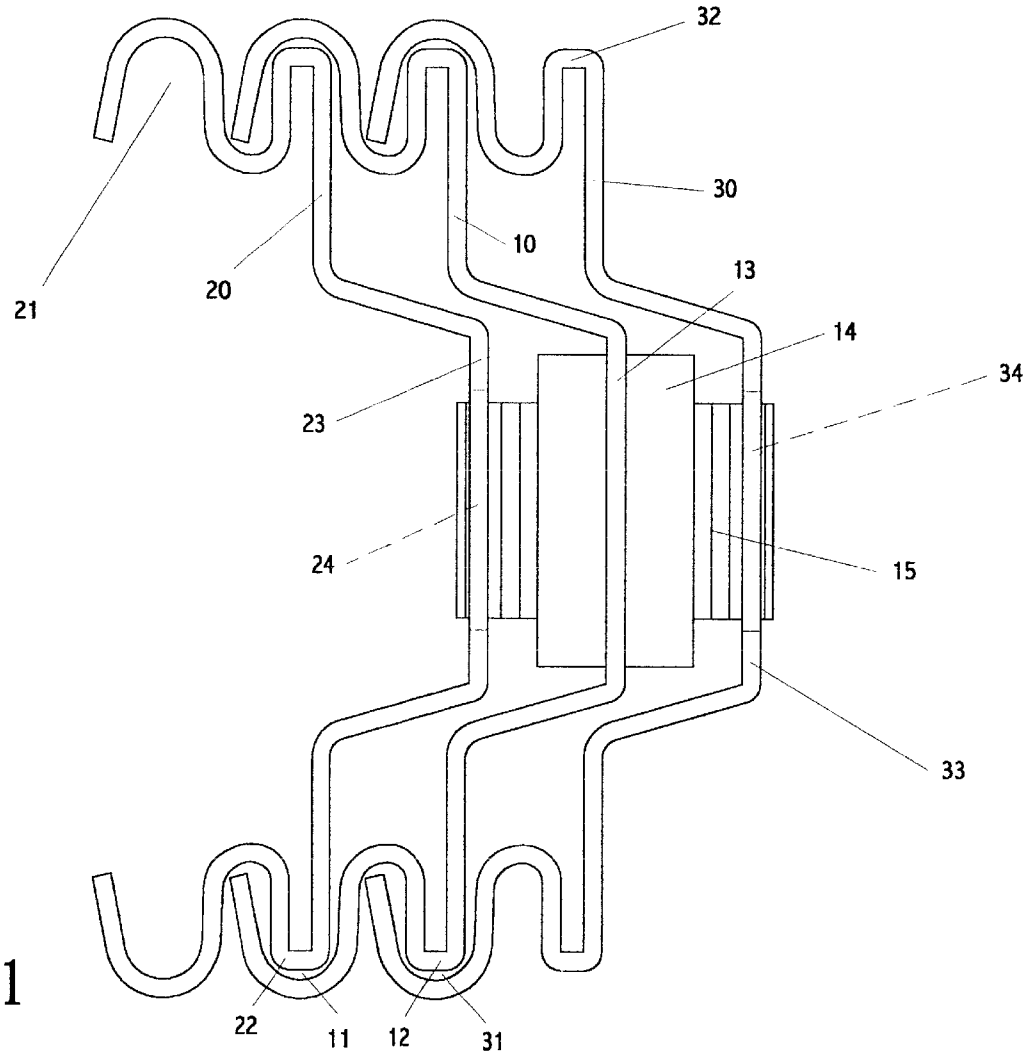
Figures 2, 5:
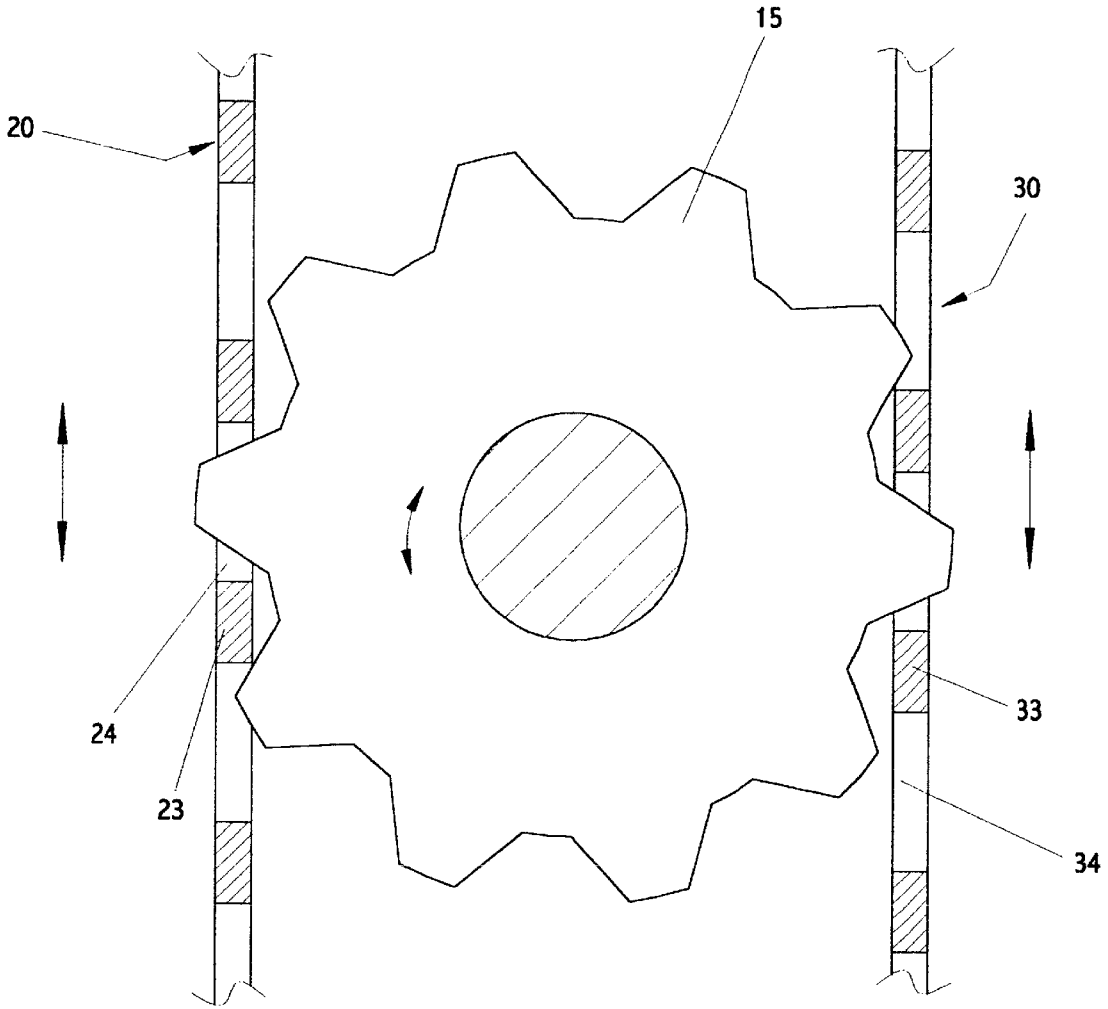

As shown in FIGS. 1–5, and FIGS. 5-1 and 5-2, the present invention comprises the component parts, which are described hereinafter.

A primary rail 10 is made of a steel material by rolling and is provided with two fitting slots 11 having a greater mouth, and two fitting protrusions 12 having a smaller mouth. A connection plate 13 is located between the fitting slot 11 and the fitting protrusion 12 and is provided in an appropriate position thereof with a rotary gear 15 mounted on a support seat 14. The connection plate 13 is provided at both ends thereof with a through hole 131, in the inner side of one end thereof with a connection piece 16 riveted thereto, and in the outer side of other end thereof with a connection piece 16 riveted thereto. The connection pieces 16 are provided with a hole in communication with the through hole 131 for locating two locating members 17 and 18 in different directions. The connection pieces 16 are fastened with legs 19.

An inner rail 20 is made of a steel material by rolling and is provided with two fitting slots 21 having a greater mouth, and two opposite fitting protrusions 22 having a smaller mouth, and a connection plate 23 located between the fitting slots and the fitting protrusions and provided with a row of toothed holes 24 contiguous to one side of the gear 15 of the primary rail 10. The fitting protrusions 22 are fitted with the fitting slots 11 of the primary rail 10 for slidably receiving the toothed portion of the gear 15 in the toothed hole 24. The toothed hole 24 of the connection plate 23 is provided with an arresting edge 25 formed outwardly by punching and pressing. The inside of the toothed hole is provided with a connection piece 26 riveted thereto.

As outer rail 30 is made of a steel material by rolling and provided with two opposite fitting slots 31 having a greater mouth, and two fitting protrusions 32 having a smaller mouth, and a connection plate 33 provided with a row of toothed holes 34. The fitting slots 31 are fitted with the fitting protrusions 12 of the primary rail 10 such that the toothed portion of the gear 15 is inserted into the toothed holes 34. Located in the inner side of the toothed holes 34 of the connection plate 33 is an arresting edge 35 which is formed by punching and pressing.

Figure 6:
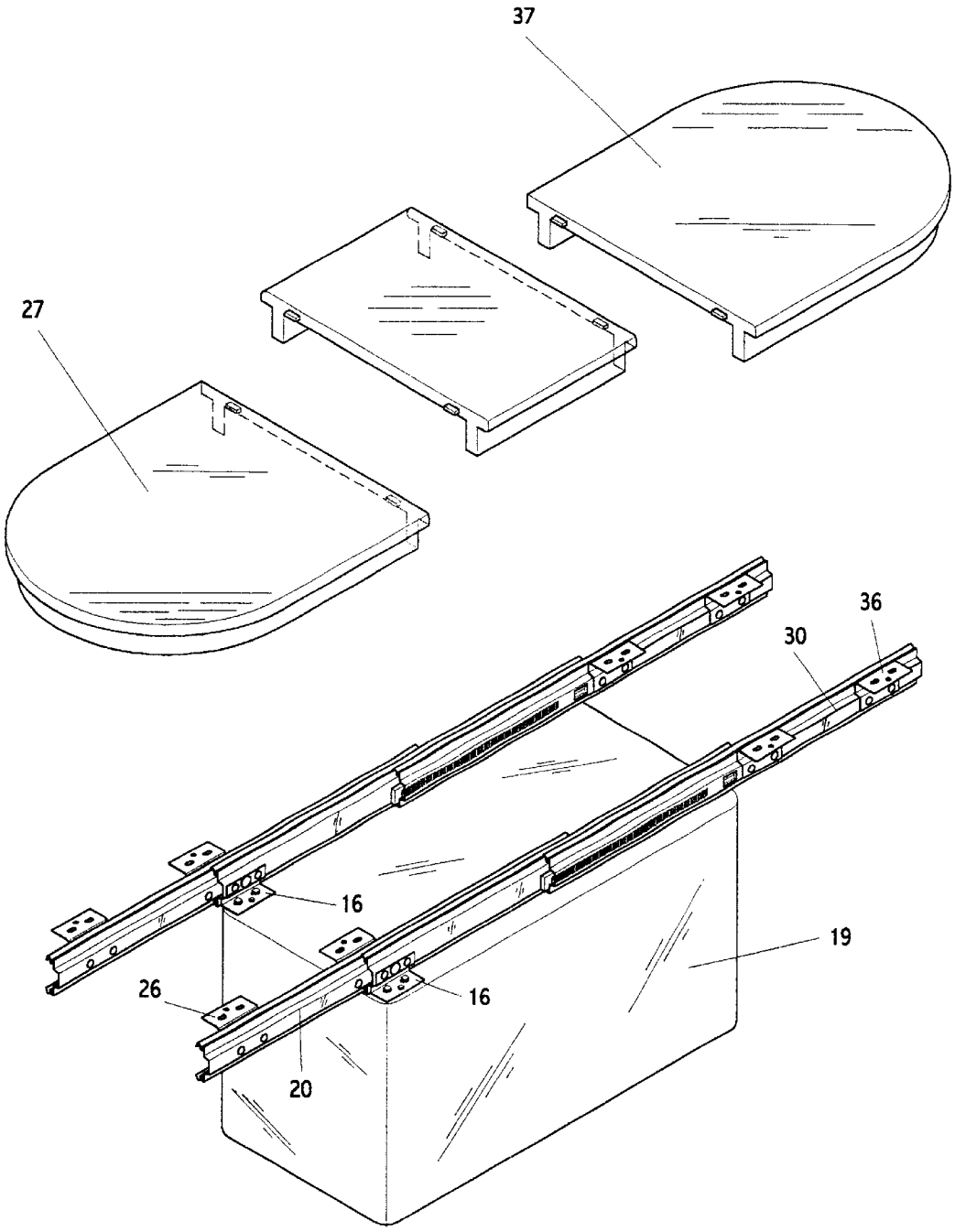
FIG. 6 shows an exploded view of the present invention and the table body.
Figure 7:
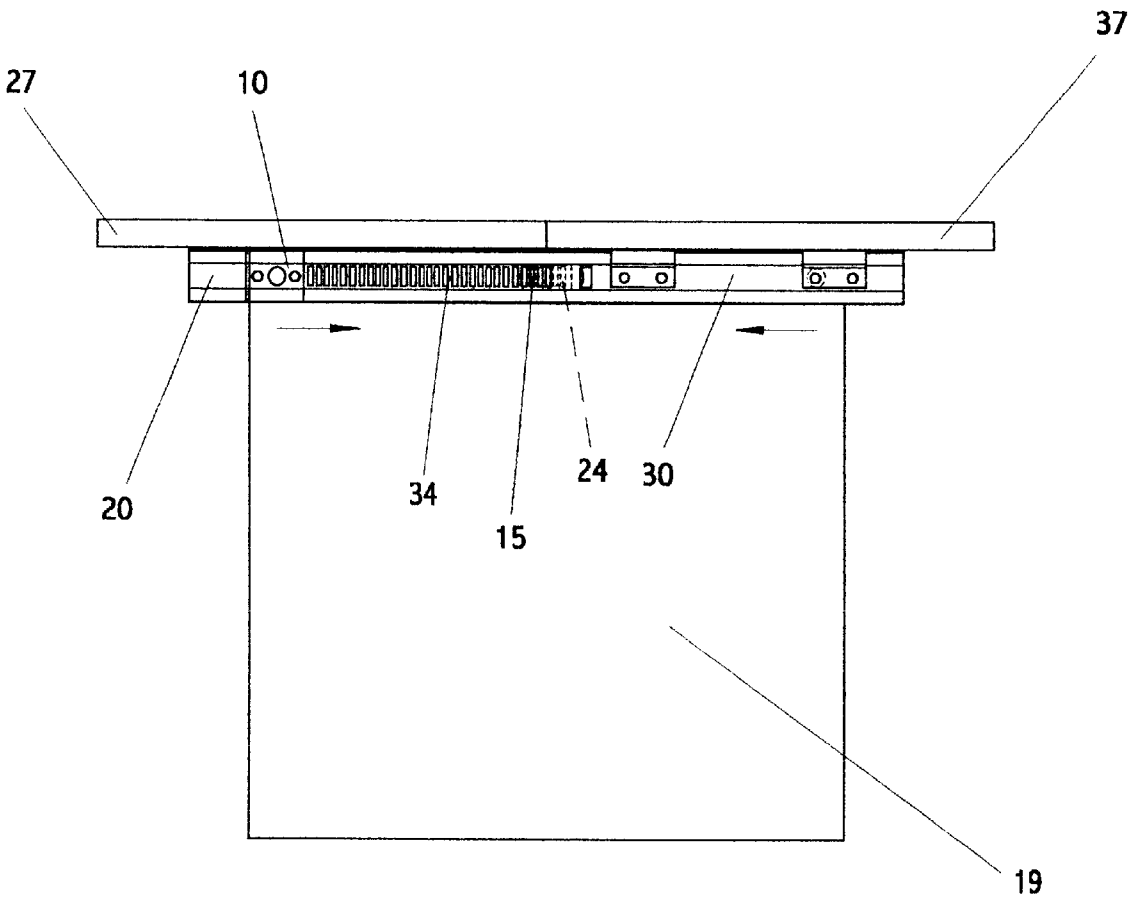
FIG. 7 shows a schematic view of the present invention at work.
Figure 8:
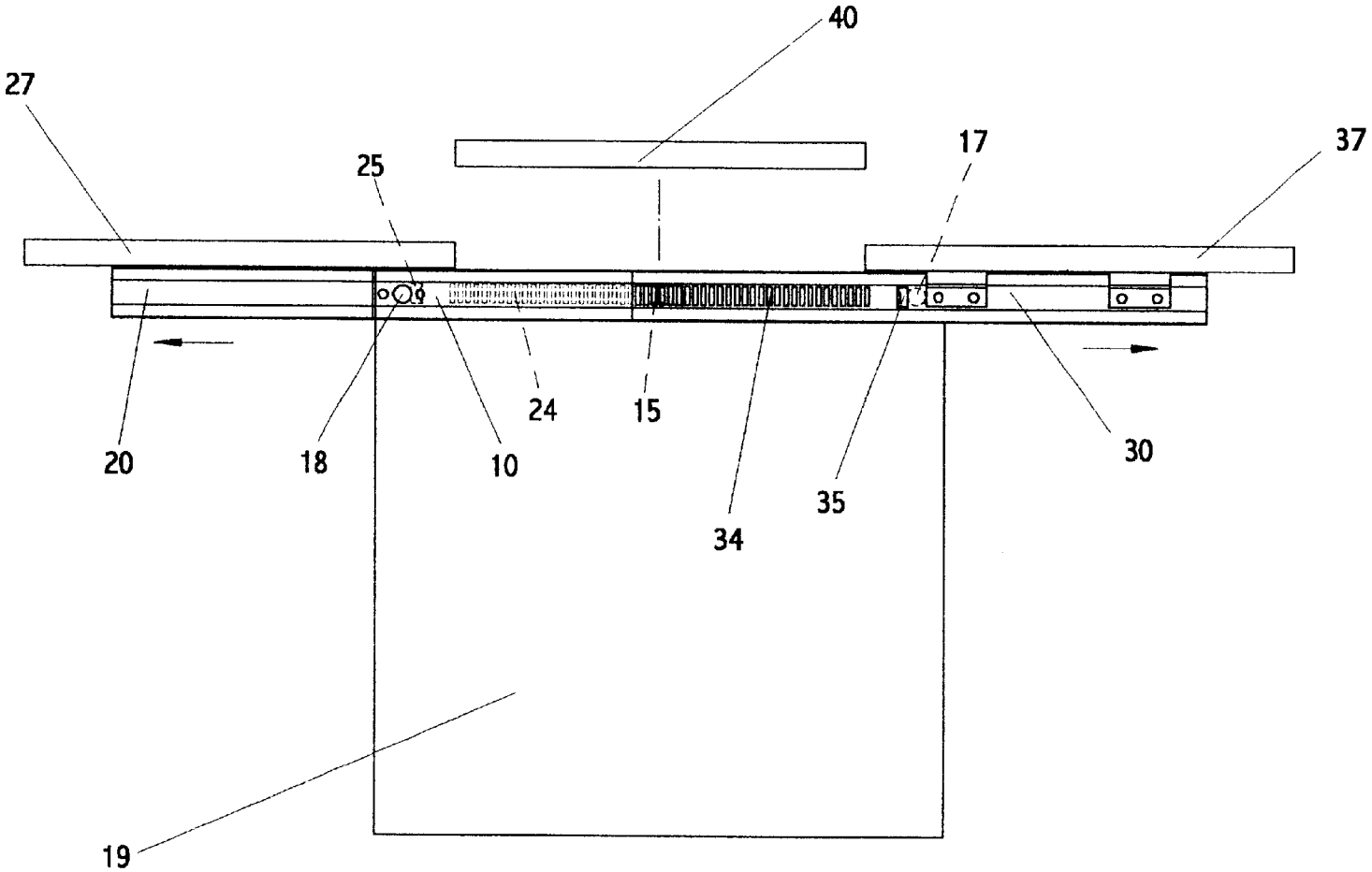
FIG. 8 shows another schematic view of the present invention at work.
Figure 9:
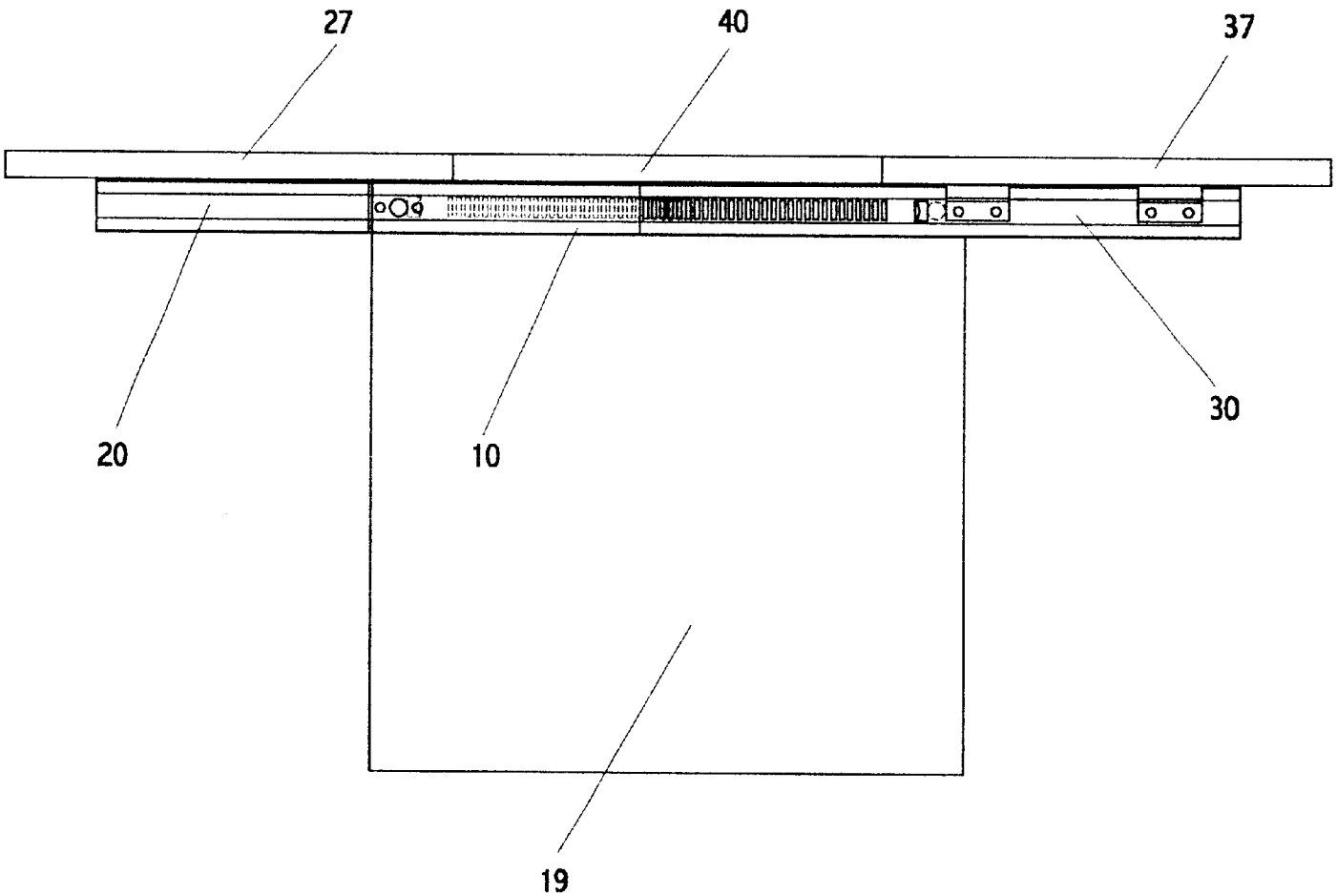
FIG. 9 shows still another schematic view of the present invention at work.
Figure 10:
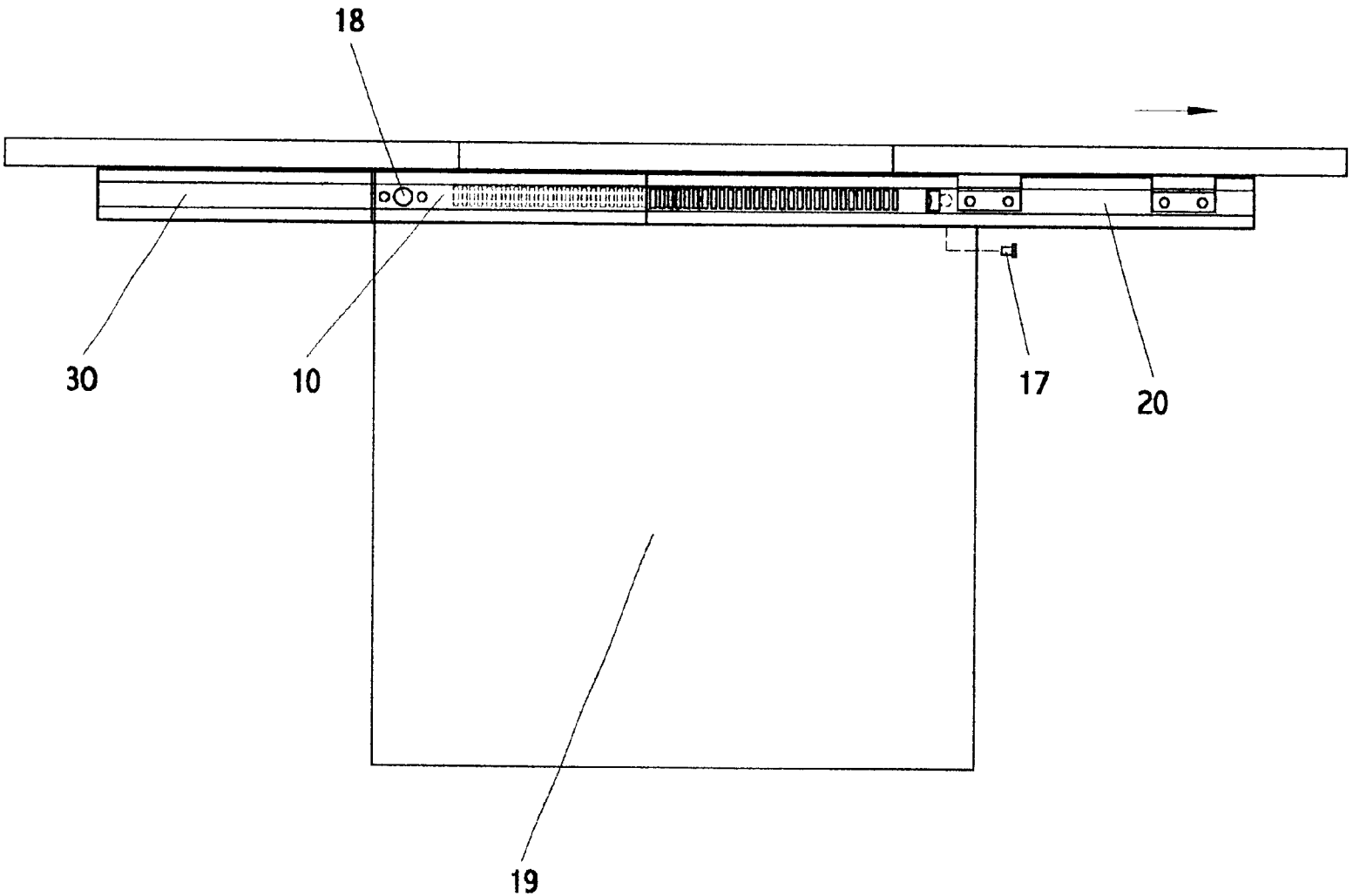
FIG. 10 shows a schematic view of the slide rails of the present invention in action.
Figure 11:
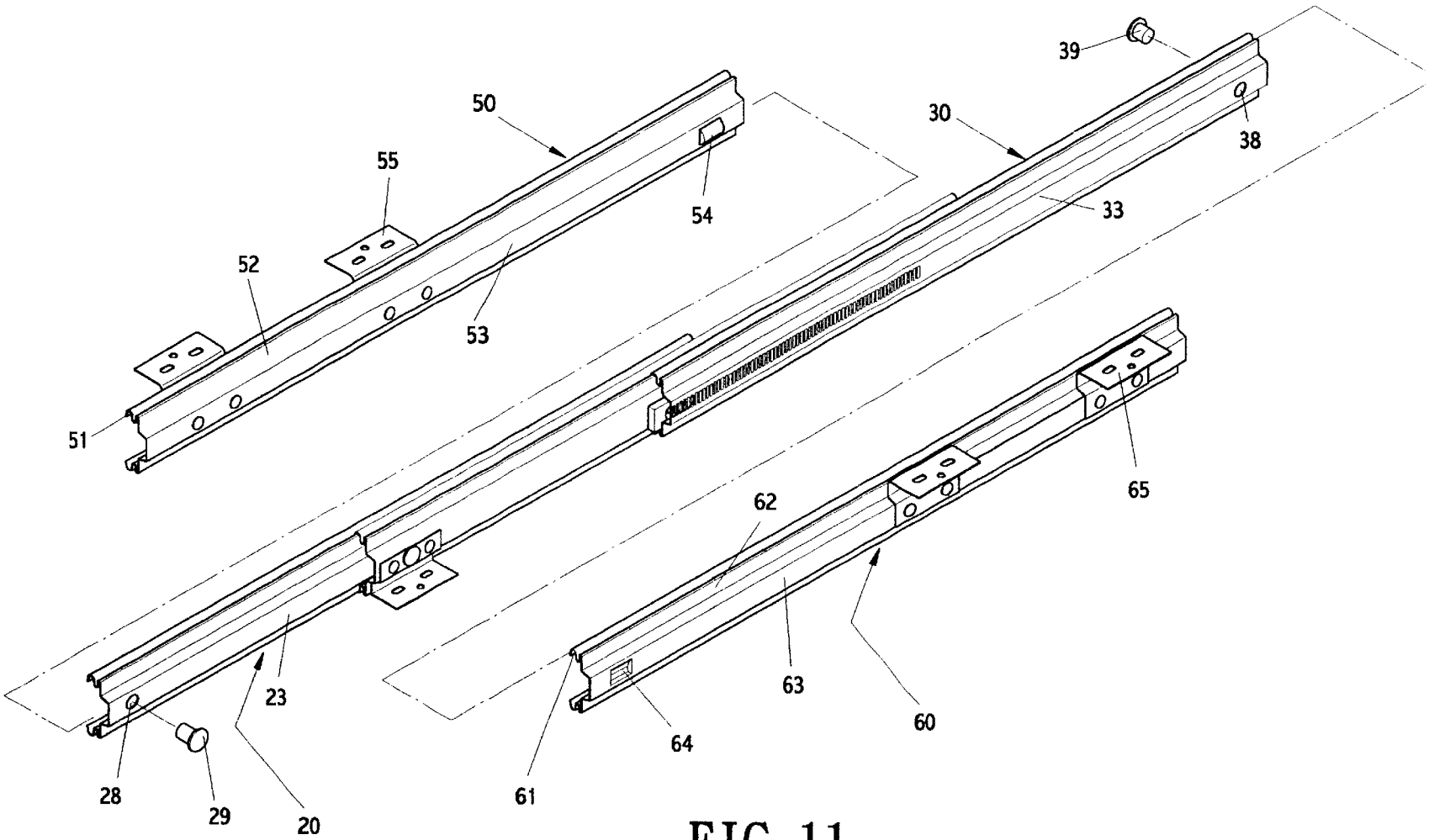
FIG. 11 shows a schematic view of another preferred embodiment of the present invention.

As shown in FIG. 6, two table leaves 27 and 37 form a table body such that the two table leaves and one leg are assembled in conjunction with two sets of slide rails, with each having the primary rail, the inner rail, and the outer rail. The connection piece 16 of the primary rail 10 is fastened with the leg 19. The table leaf 37 is fastened with the connection piece 36 of the outer rail 30. The table leaf 27 is fastened with the connection piece 26 of the inner rail 20 such that the rails are actuated by the primary rail to move outward simultaneously. However, the leg and the primary rail do not move to facilitate the displacement of the table leaves 27 and 37. The lower rail may take advantage of the primary rail to actuate another rail and another table leaf to move outwards. In the meantime, both the leg and the primary rail do not move to facilitate the pulling of two table leaves to result in an expansion of the area of the table top. At this time, the table leaves 27 and 37 are joined together by means of a cover plate 40. The table top is thus expanded. As shown in FIG. 4, FIG. 5-2, and FIG. 7, in order to reduce the area of the table top, the table leaf 37 is pushed to cause the outer rail 30 to make use of the inner displacement of the toothed holes 34 to actuate another toothed hole 24 of the inner rail 20 to move inward simultaneously. The inner rail 20 of the table leaf 27 also displaces simultaneously. The inner rail 20 and the outer rail 30 of the primary rail 10 are stacked to draw the table leaves 27 and 37 together. On the other hand, as shown in FIG. 5-2, FIGS. 8 and 9, only the table leaf 37 is pulled out, thereby resulting the outer rail 30 to make use of the toothed holes 34 to slide outward. As a result, the gear 15 of the primary rail 10 is actuated to turn such that the gear 15 actuates the toothed holes 24 of the inner rail 20 to move outward at the same time. When the outer rail 30 slides outward, the arresting edge 35 is stopped by the locating member 17 of the primary rail 10. The arresting edge 25 of the inner rail 20 is stopped by the locating member 18 of the primary rail 10. As a result, there is a space between the table leaves 27 and 37 to accommodate the cover plate 40. The area of the table top is thus expanded. As shown in FIG. 10, in the event that the inner rail 20 or the outer rail 30 is damaged, the damaged rail can be easily removed and replaced with a new one by removing first the locating member 17 or 18 of the primary rail 10 so as to enable the damaged inner rail or outer rail to be removed. As shown in FIG. 11 the inner rail 20 and the outer rail 30 of the present invention may be coupled with two extension rails 50 and 60, which are respectively provided with two fitting slots 51, 62, and two fitting protrusions 52, 62. The inner rail 20 and the outer rail 30 are respectively provided with a hole 28, 38 for locating a locating member 29, 39 for retaining an arresting edge 54, 64 of the connection plate 53, 63 connected with the extension rail 50, 60. The extension rail 50, 60 is provided in the inner or outer side thereof with a connection piece 55, 65 riveted thereto for fastening two side plates to expand the table top area.

The embodiments of the present invention described above are to be regarded in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A sliding device of a drop-leaf table, said sliding device comprising:

a primary rail provided with two opposite fitting slots, two corresponding opposite fitting protrusions, and a connection plate located between each pair of said fitting slots and said fitting protrusions and provided with a rotary gear mounted thereon, said primary rail being provided at both ends thereof with a connection piece for fastening a leg;

an inner rail provided with two opposite fitting slots and two corresponding opposite fitting protrusions, and a connection plate which is located between each pair of said fitting slots and said fitting protrusions and is provided with a row of toothed holes, said fitting protrusions being fitted into said fitting slots of said primary rail such that such rotary gear slides along said row of said toothed holes; and an outer rail provided with two opposite fitting slots and two corresponding opposite fitting protrusions, and a connection plate provided with a row of toothed holes, said fitting slots being fitted over said fitting protrusions of said primary rail such that said gear slides along said row of toothed holes;

wherein said toothed holes of both said inner and outer rails have an elongated shape aligned perpendicular to said rails, and said rotary gear has gears that are also elongated in shape corresponding to and engaged with said toothed holes of both said inner and outer rails.

2. The sliding device as defined in claim 1, wherein said connection plate of said primary rail is provided with two through holes for locating two locating members.

3. The sliding device as defined in claim 1, wherein each of said connection plates of said inner rail and said outer rail is provided with an arresting edge.

4. The sliding device as defined in claim 1, further comprising two extension rails respectively extended from an outer end of said inner and outer rails, each said extension rail being provided with two opposite fitting slots, two opposite fitting protrusions, and a connection plate whereby said extension rails are slidably engaged with said inner rail and said outer rail.

5. The sliding device as defined in claim 1, wherein said primary, inner, and outer rails are of the same dimension except that they may be of different lengths.

6. The sliding device as defined in claim 1, wherein both said inner and outer rails are provided with connection pieces for fastening a leaf of the drop-leaf table.

7. The sliding device as defined in claim 4, wherein said extension rails are provided with connection pieces for fastening a leaf of the drop-leaf table.

* * * * *